US010479079B2

(12) United States Patent
Kimura et al.

(10) Patent No.: US 10,479,079 B2
(45) Date of Patent: Nov. 19, 2019

(54) LIQUID EJECTING HEAD AND LIQUID EJECTING APPARATUS

(71) Applicant: SEIKO EPSON CORPORATION, Tokyo (JP)

(72) Inventors: Satoshi Kimura, Suwa (JP); Hitoshi Matsumoto, Matsumoto (JP); Wataru Takahashi, Chino (JP); Satoshi Suzuki, Ageo (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/845,833

(22) Filed: Dec. 18, 2017

(65) Prior Publication Data

US 2018/0178513 A1 Jun. 28, 2018

(30) Foreign Application Priority Data

Dec. 22, 2016 (JP) ..... 2016-249016

(51) Int. Cl.
*B41J 2/14* (2006.01)
*B41J 2/16* (2006.01)

(52) U.S. Cl.
CPC ..... *B41J 2/1433* (2013.01); *B41J 2/1408* (2013.01); *B41J 2/14274* (2013.01); *B41J 2/1612* (2013.01); *B41J 2002/14362* (2013.01); *B41J 2202/08* (2013.01)

(58) Field of Classification Search
CPC ..... B41J 2/14032; B41J 2/14048; B41J 2/14145; B41J 2/14201; B41J 2/14274; B41J 2/14233; B41J 2/161; B41J 2/1612; B41J 2/164; B41J 2/1618
See application file for complete search history.

(56) References Cited

U.S. PATENT DOCUMENTS 5,748,214 A * 5/1998 Usui ..... B41J 2/14233 347/40
8,292,416 B2 * 10/2012 Kihira ..... B41J 2/14233 347/71
2006/0221143 A1 * 10/2006 Kodama ..... B41J 2/14233 347/70
2014/0232787 A1 * 8/2014 Owaki ..... B41J 2/055 347/40

FOREIGN PATENT DOCUMENTS

JP 2011-062687 3/2011
JP 2014-014967 1/2014
WO 2012-144598 10/2012

* cited by examiner

*Primary Examiner* — Anh T Vo
(74) *Attorney, Agent, or Firm* — Workman Nydegger

(57) ABSTRACT

A liquid ejecting head (recording head) includes a structure (flow path member) having a plurality of stacked plates (a nozzle plate, a flow path plate, and a diaphragm) in which end surfaces at both sides in one direction are aligned. At least two plates of the plates (the nozzle plate, the flow path plate, and the diaphragm) have different coefficients of linear expansion in the one direction, and holding members are fixed to the end surfaces of the structure (flow path member) at both sides in the one direction, the holding members having stiffness higher than stiffness of a plate having the highest coefficient of linear expansion in the one direction among the plates (the nozzle plate, the flow path plate, and the diaphragm).

17 Claims, 5 Drawing Sheets

LIQUID EJECTING HEAD AND LIQUID EJECTING APPARATUS

BACKGROUND

1. Technical Field

The present invention relates to a liquid ejecting head that has a structure in which a plurality of plates are stacked and a liquid ejecting apparatus.

2. Related Art

Liquid ejecting heads are used, for example, in image recording apparatuses such as ink jet printers and ink jet plotters. Since such liquid ejecting heads can accurately eject very small amounts of liquid at predetermined positions, in recent years, the liquid ejecting heads have also been used in various manufacturing apparatuses. Such applications include, for example, display manufacturing apparatuses for manufacturing color filters for liquid crystal displays, electrode forming apparatuses for forming electrodes for organic electroluminescence (EL) displays and field emission displays (FEDs), and chip manufacturing apparatuses for manufacturing biochips (biochemical chips). A recording head for image recording apparatuses ejects liquid ink, and a color material ejection head for display manufacturing apparatuses ejects solutions of respective coloring materials of red (R), green (G), and blue (B). An electrode material ejection head for electrode forming apparatuses ejects a liquid electrode material, and a bioorganic compound ejection head for chip manufacturing apparatuses ejects a solution of bioorganic compounds.

Such a liquid ejecting head includes a plurality of plates, for example, a nozzle plate having nozzles for ejecting liquid, a diaphragm on which an actuator such as a piezoelectric element is provided, and a flow path member having a flow path in which liquid flows. Each of the plates is made of an optimum material selected from various materials such as metal and silicon in consideration of various factors such as ease of manufacturing (processing), characteristics of the plate, and purpose and application of the liquid ejecting head. Considering the above-mentioned factors, it is impractical to form all the plates constituting the liquid ejecting head by using the same material. The different materials cause differences in coefficients of thermal expansion (coefficients of linear expansion) among the plates constituting the liquid ejecting head. Due to the differences in the coefficients of thermal expansion of the plates, problems such as warpage in the liquid ejecting head may occur. To suppress the warpage in the liquid ejecting head, there is disclosed an ink jet head that has, between plates (a head chip and a holding member), adhesion regions in which the holding member and the head chip are adhered to each other and non-adhesion regions in which the holding member and the head chip are not adhered to each other. The adhesion regions and the non-adhesion regions are alternately provided with each other along a nozzle arrangement direction (see International Publication No. WO2012/144598).

In the structure disclosed in International Publication No. WO2012/144598, the holding member is allowed to extend (expand) in the nozzle-arrangement direction, and when temperature rises, a stress is produced between the head chip and the holding member due to the extension. This stress concentrates in the adhesion regions of the head chip and the holding member, and the adhesive may come off in the regions. As a result, the reliability of the liquid ejecting head may decrease.

SUMMARY

An advantage of some aspects of the invention is that there is provided a liquid ejecting head in which reduction in reliability is suppressed at low cost and a liquid ejecting apparatus.

A liquid ejecting head according to an aspect of the invention includes a structure having a plurality of stacked plates in which end surfaces at both sides in one direction are aligned. At least two plates of the plates have different coefficients of linear expansion in the one direction, and holding members are fixed to the end surfaces of the structure at both sides in the one direction, the holding members having stiffness higher than stiffness of a plate having the highest coefficient of linear expansion in the one direction among the plates.

According to this aspect of the invention, even if the temperature of the structure rises, the holding members can suppress the extension of the plates in the one direction. With this structure, the stress between the plates can be reduced and for example, an adhesive that bonds the plates can be prevented from peeling off. As a result, reduction in reliability of the liquid ejecting head can be suppressed.

In the above-described structure, it is preferable that each of the holding members have a recessed portion, and the end surfaces of the structure be fit in the recessed portions.

With this structure, the holding members can be firmly fixed to the structure. Especially, the holding members can suppress the thermal expansion of the structure in the plate-stacking direction when the structure is fit in the recessed portions. Accordingly, when the temperature of the structure rises, a force is applied toward the inside in the direction of holding the structure, that is, in the plate-stacking direction, and thereby an adhesive that bonds the plates can be prevented from peeling off.

Furthermore, it is preferable that the end surfaces of the structure be in contact with the holding members.

With this structure, the plates can be further prevented from extending in the one direction.

Furthermore, it is preferable that a filler be provided between the structure and the holding members.

With this structure, the holding members can be more firmly fixed to the structure.

Furthermore, it is preferable that, in the structure including the plates, a plate contain silicon as a main component and a plate contain a metal as a main component.

With this structure, the plates can be more easily processed and the liquid ejecting head can be more easily manufactured.

According to another aspect of the invention, a liquid ejecting apparatus includes any one of the above-described liquid ejecting heads.

According to this aspect, reduction in reliability of the liquid ejecting apparatus can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
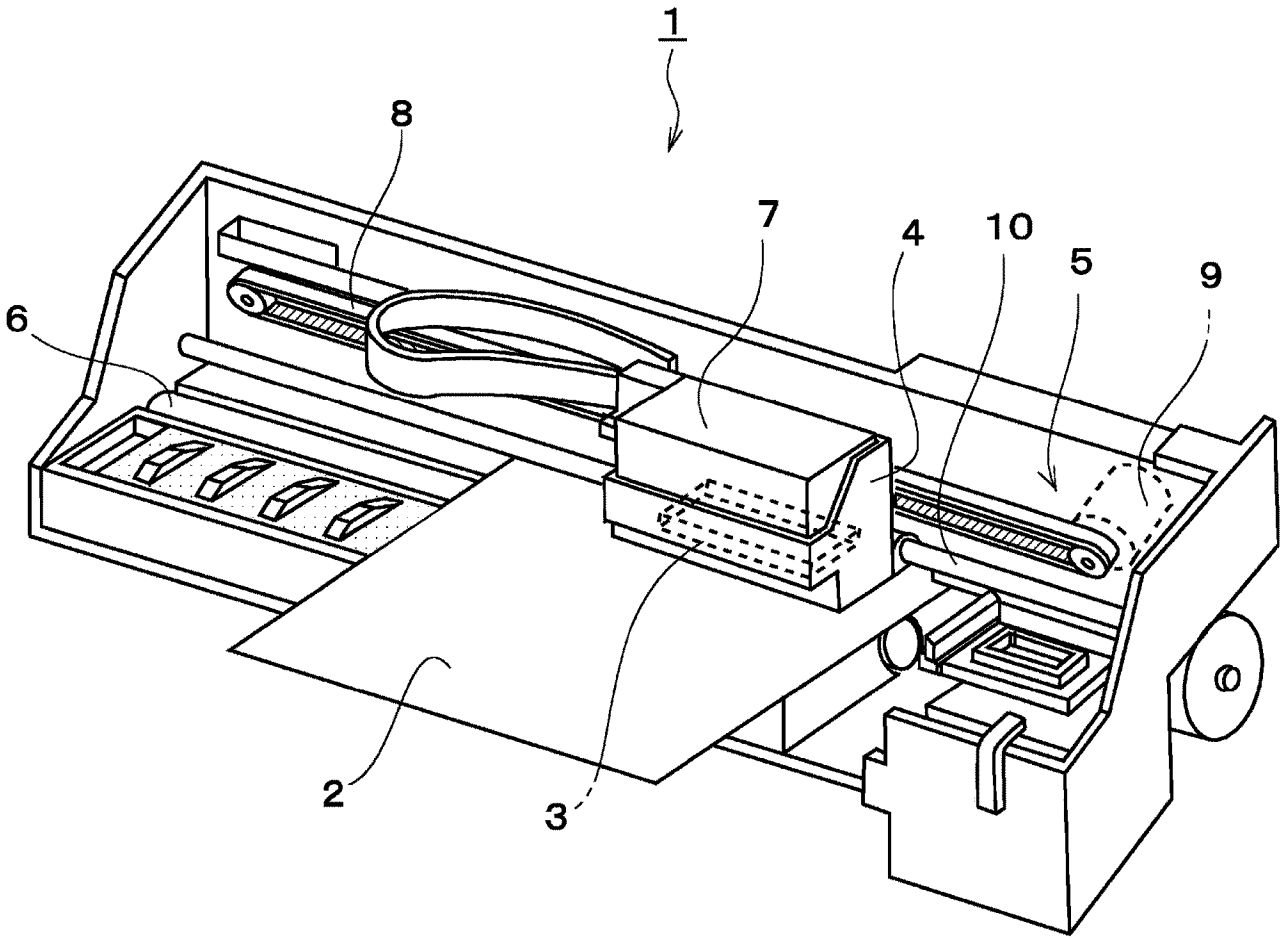
FIG. 1 is a perspective view of a structure of a printer.

Hereinafter, the embodiments of the present invention will be described with reference to the attached drawings. Although various limitations are given in the embodiments described below in order to illustrate specific preferred examples of the invention, it should be noted that the scope of the invention is not intended to be limited to these embodiments unless such limitations are explicitly mentioned hereinafter. In the description below, as an example liquid ejecting head according to an embodiment of the invention, an ink jet recording head (hereinafter, referred to as a recording head) 3 provided on an ink jet printer (hereinafter, referred to as a printer) 1, which is one type of liquid ejecting apparatus, will be described. FIG. 1 is a perspective view of the printer 1.

The printer 1 is a device that records, for example, an image onto a surface of a recording medium 2 (a kind of target on which ink droplets are to be ejected) such as recording paper by ejecting ink (a kind of liquid) onto the recording medium 2. The printer 1 includes a recording head 3, a carriage 4 to which the recording head 3 is attached, a carriage moving mechanism 5 that moves the carriage 4 in a main scanning direction, and a transportation mechanism 6 that transports the recording medium 2 in a subscanning direction. An ink cartridge 7 stores the ink, and serves the ink as a liquid supply source. The ink cartridge 7 can be detachably attached to the recording head 3. The ink cartridge may be provided to the body side of the printer, and the ink may be supplied from the ink cartridge to the recording head via an ink supply tube.

The carriage moving mechanism 5 includes a timing belt 8. The timing belt 8 is driven by a pulse motor 9, for example, a direct current motor (DC motor). Consequently, when the pulse motor 9 operates, the carriage 4 reciprocates in the main scanning direction (the width direction of the recording medium 2) while being guided by a guide rod 10 that is provided in the printer 1. A linear encoder (not shown), which is a kind of positional information detection device, detects a position of the carriage 4 in the main scanning direction. The linear encoder sends the detected signal, i.e., an encoder pulse (a kind of positional information), to a controller of the printer 1.

Figure 2:
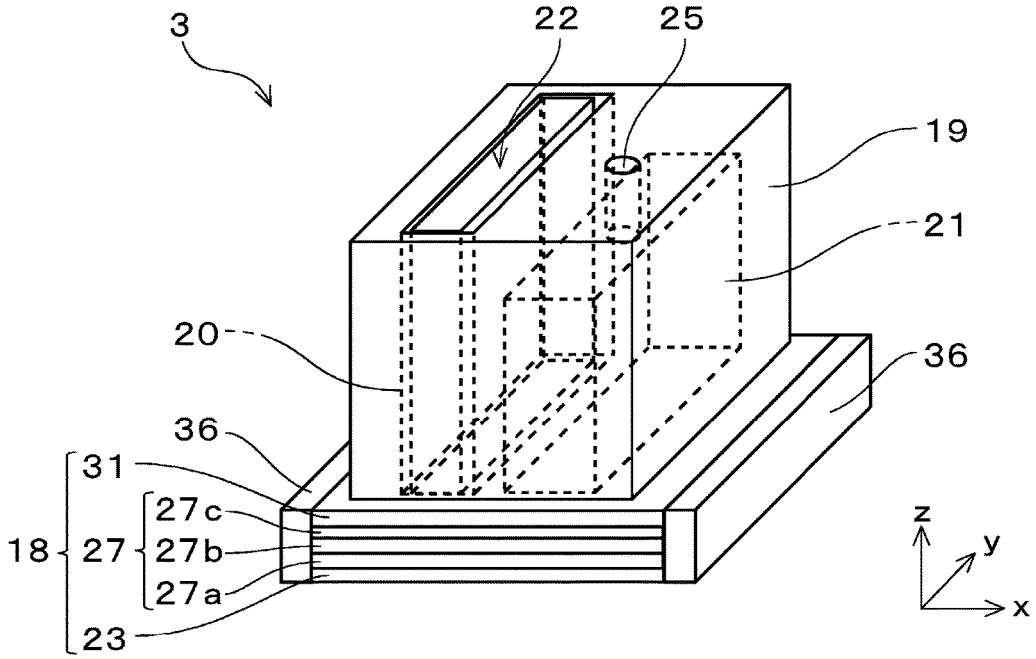
FIG. 2 is a perspective view of a structure of a recording head.
Figure 3:
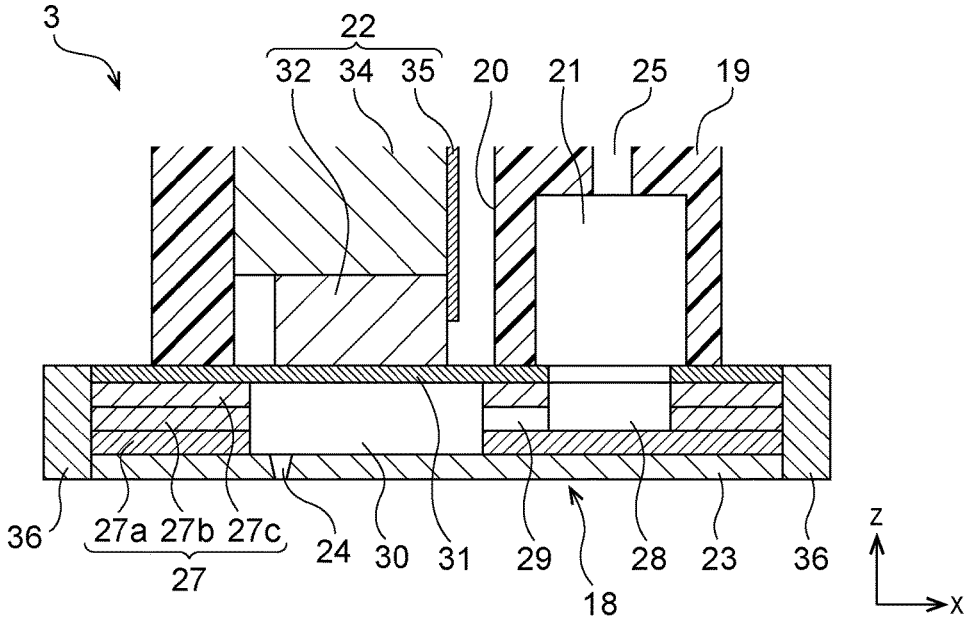
FIG. 3 is a cross-sectional view of a structure of the recording head.

Next, the recording head 3 is described. FIG. 2 is a perspective view of the recording head 3, and FIG. 3 is a cross-sectional view of a main part of the recording head 3. In the following description, a stacking direction (z direction in FIG. 2 and FIG. 3) of the components is referred to as an up-down direction as appropriate. As illustrated in FIG. 2 and FIG. 3, an actuator unit 22 and a frame member 19 are provided on an upper surface of a flow path member 18 (corresponding to a structure according to the embodiments of the invention), and holding members 36 are provided on side surfaces of the flow path member 18.

The frame member 19 according to the embodiment is a box-shaped member of synthetic resin or metal. As illustrated in FIG. 2 and FIG. 3, an accommodating space 20, which is elongated in a nozzle array direction (y direction in FIG. 2), is provided in the frame member 19. The accommodating space 20 is a through hole that is open in the frame member 19 in a thickness direction (z direction) to accommodate the actuator unit 22. In the frame member 19, a common liquid flow path 21, in which an ink flows, is provided. The common liquid flow path 21 is a blind hole that is recessed from a lower surface of the frame member 19 to the middle in the thickness direction (z direction) and is used to supply an ink to a plurality of pressure chambers 30. A lower end of the common liquid flow path 21 is connected to a supply liquid chamber 28, which will be described below. An upper end of the common liquid flow path 21 is connected to a liquid inlet 25, which is provided in an upper surface of the frame member 19.

The flow path member 18 is a composite substrate that includes a nozzle plate 23, a flow path plate 27, and a diaphragm 31, which are stacked. In this embodiment, the nozzle plate 23, flow path plate 27, and diaphragm 31 have the same outer diameter. In other words, the positions of both end surfaces of the nozzle plate 23, the flow path plate 27, and the diaphragm 31 in the nozzle array direction (y direction) are aligned. Furthermore, the positions of both end surfaces of the nozzle plate 23, the flow path plate 27, and the diaphragm 31 in the direction (x direction) that intersects the nozzle array direction are aligned. The phrase "positions are aligned" in the embodiments of the invention means that the dimensions on the design are aligned and includes variations within the range of manufacturing tolerance, that is, within specification allowable range.

The flow path plate 27 includes a first flow path plate 27*a*, a second flow path plate 27*b*, and a third flow path plate 27*c*, which are stacked from the lower surface side (that is, the nozzle plate 23 side) in this order. The flow path plate 27 (that is, the first flow path plate 27*a*, the second flow path plate 27*b*, and the third flow path plate 27*c*) according to the embodiment is made of silicon, and is fabricated, for example, by processing a silicon single crystal substrate by etching. In other words, the flow path plate 27 is a plate that contains silicon as a main component.

A supply liquid chamber 28, an individual communication path 29, and a pressure chamber 30 are provided in the flow path plate 27. The supply liquid chamber 28 communicates with the common liquid flow path 21 and stores an ink, which is commonly supplied to the pressure chambers 30, together with the common liquid flow path 21. The supply liquid chamber 28 according to the embodiment is defined by a space in the second flow path plate 27*b* and a space in the third flow path plate 27*c*, which communicates with each other. The individual communication path 29 communicates with the supply liquid chamber 28 and the pressure chamber 30 and is provided for each pressure chamber 30. A plurality of individual communication paths 29 are provided in the nozzle array direction (y direction) so as to correspond to the plurality of pressure chambers 30, which are provided in the nozzle array direction. The individual communication paths 29 according to the embodiment are provided in the second flow path plate 27*b*. The individual communication paths 29 can apply resistance to the ink that are flowing between the pressure chambers 30 and the supply liquid chambers 28.

The pressure chamber 30 is a through hole provided in the flow path plate 27 in the plate thickness direction (z direction), that is, a space defined by the first flow path plate 27*a*, the second flow path plate 27*b*, and the third flow path plate 27*c*. The opening of the pressure chamber 30 on an upper surface side is sealed by the diaphragm 31 and the opening on a lower surface side is sealed by the nozzle plate 23. The plurality of pressure chambers 30 are provided in the nozzle array direction (y direction) so as to correspond to the nozzles 24, that is, the nozzle array. Each pressure chamber 30 is elongated in a direction (x direction) that intersects the nozzle array direction. The individual communication path 29 communicates with an end portion on one side of the pressure chamber 30 in the lengthwise direction and the nozzle 24 communicates with an end portion on another side.

The nozzle plate 23 is a metal plate that is bonded with an adhesive to a lower surface of the flow path plate 27. The nozzle plate 23 according to the embodiment is made of a nickel (Ni) plate, that is, a plate that contains nickel as a main component. The nozzle plate 23 seals the lower surface side of the opening of the pressure chamber 30. In the nozzle plate 23, a plurality of nozzles 24 (that is, nozzle array) are open in line (that is, in row), for example, in a subscanning direction (y direction), which intersects the main scanning direction. The nozzles 24, which constitute the nozzle array, are evenly spaced from the nozzle 24 at one end side to the nozzle 24 at the other end side in the subscanning direction at a pitch that corresponds to a dot formation density.

The diaphragm 31 is a metal substrate that is bonded with an adhesive to an upper surface of the flow path plate 27. The diaphragm 31 according to the embodiment is made of a nickel (Ni) plate, that is, a plate that contains nickel as a main component, by electroforming in a multi-layered structure. The diaphragm 31 seals the upper opening of the pressure chamber 30. In other words, the diaphragm 31 defines the upper surface of the pressure chamber 30. Although not shown in the drawings, a section to which a piezoelectric element 32 is bonded in an area in the diaphragm 31, the area corresponding to the pressure chamber 30, is a thick film section that is relatively thick and a section other than the thick film section is a thin film section that is relatively thin. The thin film section is a deformable section that is elastically deformable. An opening (not illustrated) that communicates with the supply liquid chamber 28 and the common liquid flow path 21 is provided in a section of the area corresponding to the supply liquid chamber 28 in the diaphragm 31.

As described above, in the flow path member 18 according to the embodiment, the silicon flow path plate 27, which has a relatively low coefficient of linear expansion, is sandwiched between the nickel nozzle plate 23 and the nickel diaphragm 31, which have relatively high coefficients of linear expansion. The nozzle plate 23, the flow path plate 27, and the diaphragm 31, which constitute the flow path member 18, have following dimensions, for example. That is, a dimension of the nozzle plate 23, the flow path plate 27, and the diaphragm 31 in the widthwise direction (x direction) is within a range from about 7 mm to about 12 mm, and a dimension of the nozzle plate 23, the flow path plate 27, and the diaphragm 31 in the lengthwise direction (y direction) is within a range from about 33 mm to about 45 mm. The nozzle plate 23 has a thickness (dimension in the z direction) within a range from about 45 μm to about 70 μm, the flow path plate 27 has a thickness within a range from about 350 μm to about 450 μm, and the diaphragm 31 has a thickness within a range from about 15 μm to about 25 μm.

An actuator unit 22 includes a base member 34 that is attached to the frame member 19, a piezoelectric element group that includes a plurality of piezoelectric elements 32, and a flexible substrate 35 (wiring member). The piezoelectric elements 32 in the piezoelectric element group are arranged in a comb-teeth shape in which the piezoelectric elements 32 are separated at predetermined intervals in the nozzle array direction (y direction). The piezoelectric element 32 can expand or contract in the up-down direction (z direction), and a tip portion of a free end portion is joined to the diaphragm 31, more specifically, to the thick film section. A fixation end portion, which is opposite to the free end portion of the piezoelectric element 32, is joined to the base member 34. The flexible substrate 35 is a flexible wiring board, and one end of the flexible substrate 35 is connected to the piezoelectric element 32, and the other end is connected to a controller (not illustrated) of the printer 1. A drive signal from the controller is sent to the piezoelectric element 32 via the flexible substrate 35. In response to the supply of the drive signal to the piezoelectric element 32, the piezoelectric element 32 expands or contracts in the up-down direction in accordance with the drive signal and this movement causes pressure fluctuation in the ink in the pressure chamber 30. The pressure fluctuation causes the recording head 3 to eject ink droplets from the nozzles 24, which communicate with the pressure chambers 30, or to slightly vibrate meniscuses in the nozzles 24 to the extent that the ink is not ejected.

A holding member 36 is a plate-like member that has stiffness higher than that of a plate (in this embodiment, the nickel nozzle plate 23 or the nickel diaphragm 31) that has the highest coefficient of linear expansion in the direction (x direction) intersecting the nozzle array direction among the plates in the flow path member 18. In other words, the holding member 36 is made of a material (for example, a martensite stainless steel) that has a Young's modulus higher than those of the nickel plates that are made by electroforming and used as the nozzle plate 23 and the diaphragm 31. The holding member 36 according to the embodiment is elongated in the lengthwise direction (y direction) of the flow path member 18 and the dimension of the holding member 36 in the lengthwise direction is aligned with that of the flow path member 18. The thickness (the dimension in the z direction) of the holding member 36 is substantially the same as the thickness of the flow path member 18. The dimension of the holding member 36 in the widthwise direction (x direction) may be any dimension as long as deformation of the flow path member 18 can be suppressed, for example, a dimension larger than the thickness of the flow path member 18. Specifically, the holding member 36 may be a plate that has dimensions, for example, a dimension in the x direction within a range from about 2 mm to about 4 mm, a dimension in the y direction within a range from about 33 mm to about 45 mm, and a dimension in the z direction within a range from about 0.4 mm to about 0.6 mm. The holding members 36 according to the embodiment are fixed to both end surfaces of the flow path member 18 in the direction (x direction) intersecting the nozzle array direction, for example, by an adhesive (filler). The holding members 36 may be fixed by mechanical components such as screws.

As described above, since the holding members 36 are fixed to both end surfaces of the flow path member 18 in the direction (x direction) intersecting the nozzle array direction, even if the temperature of the flow path member 18 rises, the holding members 36 prevent the plates (specifically, the nozzle plate 23, the flow path plate 27, and the diaphragm 31) constituting the flow path member 18 from extending in the direction (x direction) intersecting the nozzle array direction. In other words, even if the plates that constitute the flow path member 18 extend with the temperature rise in the flow path member 18, the holding members 36 can suppress the extension. Especially, the holding members 36 can suppress the extension of the nozzle plate 23 and the diaphragm 31, which have relatively high coefficients of linear expansion, in the direction (x direction) intersecting the nozzle array direction. With this structure, the stresses between the flow path plate 27, which has a relatively low coefficient of linear expansion and an amount of extension is smaller than those of the nozzle plate 23 and the diaphragm 31, and the nozzle plate 23 and/or the diaphragm 31 can be reduced. As a result, the adhesive that bonds the flow path plate 27 and the nozzle plate 23 and the adhesive that bonds the flow path plate 27 and the diaphragm 31 can be prevented from peeling off. Consequently, the decrease in the reliability of the recording head 3 and further the decrease in the reliability of the printer 1 can be suppressed. Furthermore, since the nozzle plate 23 is made of nickel and can be made by press processing, laser processing, or the like, the nozzle plate 23 can be processed more easily. Furthermore, since the flow path plate 27 is made of silicon and can be made by etching, or the like, the flow path plate 27 can be processed more easily. Accordingly, the flow path member 18 and also the recording head 3 can be manufactured more easily.

It should be noted that the structure of the holding members 36 is not limited to the above-described example. For example, holding members 36 illustrated in FIG. 4 to FIG. 6 may be used. Hereinafter, specific examples will be described with reference to the drawings.

Figure 4:
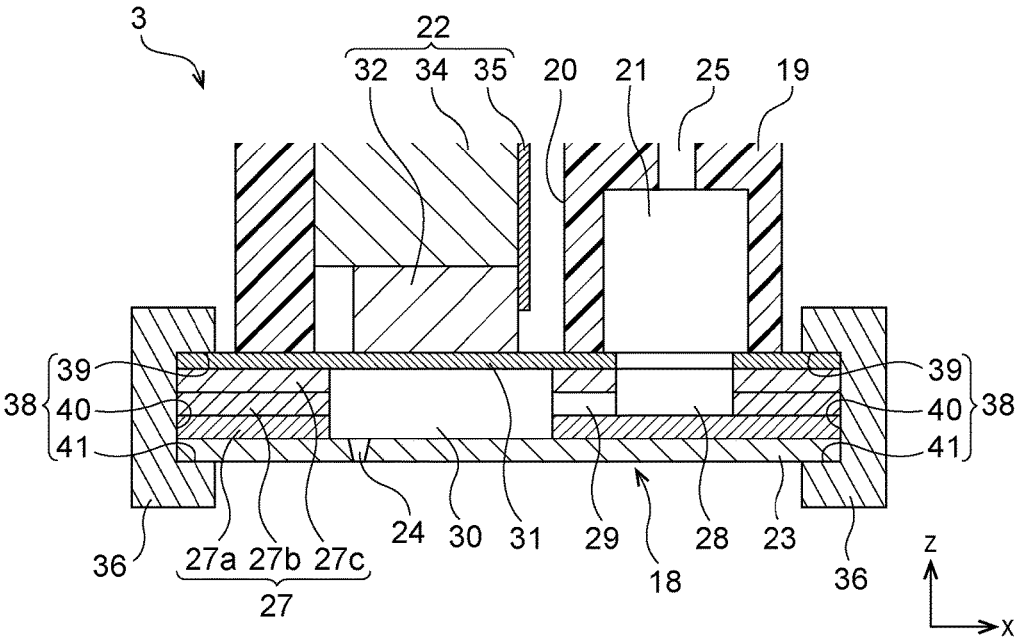
FIG. 4 is a cross-sectional view of a recording head according to a second embodiment.

A holding member 36 according the second embodiment illustrated in FIG. 4 includes a recessed portion 38 in which an end portion (that is, a section including the end surface) of the flow path member 18 is accommodated. In other words, the holding member 36 according to the embodiment includes the recessed portion 38 that has a thickness (dimension in the z direction) greater than that of the flow path member 18, and the surface that faces the end surface of the flow path member 18 in the central portion in the thickness direction is recessed to the middle of the holding member 36 in the widthwise direction (x direction). The recessed portion 38 according to the embodiment has a first surface 39 that faces the upper surface of the flow path member 18 and is parallel to the upper surface, a second surface 40 that faces the end surface of the flow path member 18 and is parallel to the end surface, and a third surface 41 that faces the lower surface of the flow path member 18 and is parallel to the lower surface. The height (the dimension in the z direction) of the second surface 40 is substantially the same as the thickness of the flow path member 18. The holding member 36 is fit to the end portion of the flow path member 18 such that the first surface 39 and the third surface 41 hold the upper surface and lower surface of the flow path member 18. In this embodiment, the holding members 36 are fixed to both end surfaces of the flow path member 18 in the direction (x direction) intersecting the nozzle array direction.

To fix the holding members 36 and the flow path member 18, for example, an adhesive (filler) may be filled between the upper surface (the surface of the diaphragm 31) of the flow path member 18 and the first surface 39 and the lower surface (the surface of the nozzle plate 23) of the flow path member 18 and the third surface 41. In this example, each of the second surfaces 40 of the holding members 36 may be in contact with each of the end surfaces of the flow path member 18. In other words, the end surfaces of the flow path member 18 may be in contact with the holding members 36. With this structure, even if the plates that constitute the flow path member 18 extend in the direction (x direction) intersecting the nozzle array direction with the temperature rise in the flow path member 18, the holding members 36 can further suppress the extension. That is, the plates that constitute the flow path member 18 are further prevented from extending (expanding) in the direction (x direction) intersecting the nozzle array direction. As a result, the adhesive that bonds the flow path plate 27 and the nozzle plate 23 and the adhesive that bonds the flow path plate 27 and the diaphragm 31 can be prevented from peeling off. Alternatively, the flow path member 18 and the second surface 40 may be bonded by filling an adhesive (filler) between the end surface of the flow path member 18 and the second surface 40. In this case, the adhesive (filler) may be filled also between the upper surface of the flow path member 18 and the first surface 39 and between the lower surface of the flow path member 18 and the third surface 41 or no adhesive (filler) may be used. As described above, the holding members 36 can be further firmly fixed to the flow path member 18 by filling an adhesive (filler) between the end surfaces of the flow path member 18 and the second surfaces 40.

In this embodiment, since the end portions of the flow path member 18 are fit into the recessed portions 38 of the holding members 36, the holding members 36 can suppress the thermal expansion of the flow path member 18 in the plate-stacking direction (z direction). As a result, when the temperature of the flow path member 18 rises, forces are applied toward the inside in the plate-stacking direction, that is, in the directions of holding the flow path member 18. With this structure, the adhesive that bonds the flow path plate 27 and the nozzle plate 23 and the adhesive that bonds the flow path plate 27 and the diaphragm 31 can be further prevented from peeling off. The other structures are similar to those in the first embodiment, and accordingly, their descriptions are omitted.

Figure 5:
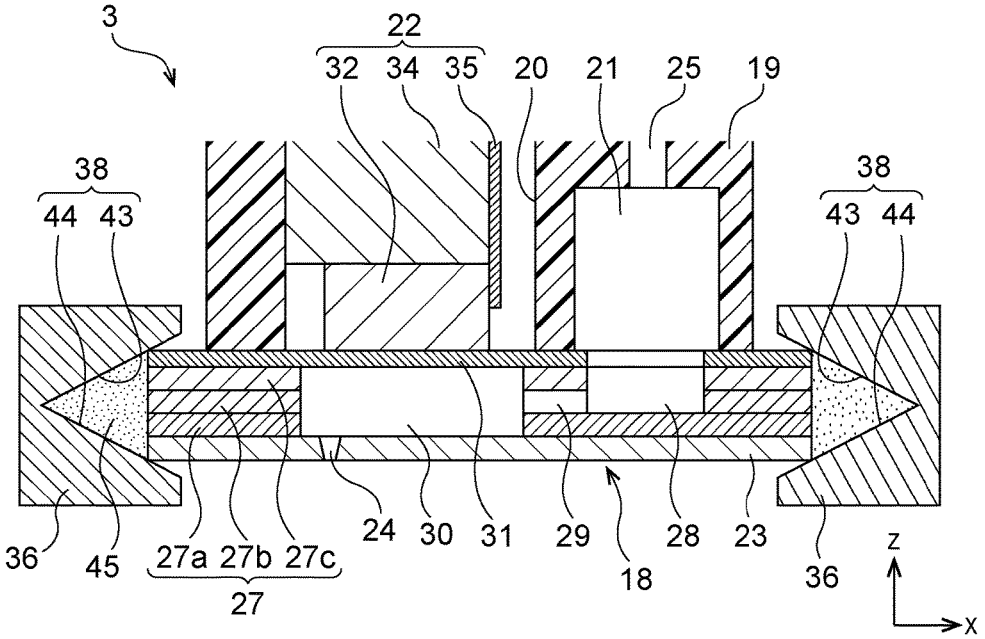
FIG. 5 is a cross-sectional view of a recording head according to a third embodiment.

A holding member 36 according to the third embodiment illustrated in FIG. 5 has a recessed portion 38 in which surfaces are inclined with respect to the end surface of the flow path member 18. Specifically, the recessed portion 38 in the holding member 36 according to the embodiment has a first inclined surface 43 that is inclined downward from the upper surface of the flow path member 18 in a direction away from the flow path member 18 and a second inclined surface 44 that is inclined upward from the lower surface of the flow path member 18 in a direction away from the flow path member 18. In other words, the recessed portion 38 is open toward the end surface of the flow path member 18. The end portion of the flow path member 18 is held between the first inclined surface 43 and the second inclined surface 44 in the recessed portion 38. In this embodiment, a filler 45 is filled in a space between the end surface of the flow path member 18 and the surfaces, which face the end surface, in the recessed portion 38, that is, the space that is defined by the end surface of the flow path member 18, the first inclined surface 43, and the second inclined surface 44. With the filler 45, the holding member 36 is fixed to the flow path member 18.

As described above, the end portion of the flow path member 18 is held between the first inclined surface 43 and the second inclined surface 44, and accordingly, the extension (expansion) of the nozzle plate 23 and the diaphragm 31 in the direction (x direction) intersecting the nozzle array direction can be suppressed. With this structure, when the temperature of the flow path member 18 rises, the stress between the flow path plate 27 and the nozzle plate 23 and/or the diaphragm 31 can be reduced. As a result, the adhesive that bonds the flow path plate 27 and the nozzle plate 23 and the adhesive that bonds the flow path plate 27 and the diaphragm 31 can be prevented from peeling off. Furthermore, when the flow path member 18 thermally expands, forces are applied toward the inside in the plate-stacking direction (z direction), that is, in the directions of holding the flow path member 18. As a result, the adhesive that bonds the flow path plate 27 and the nozzle plate 23 and the adhesive that bonds the flow path plate 27 and the diaphragm 31 can be further prevented from peeling. Furthermore, since the opening of the recessed portion 38 is open toward the end surface of the flow path member 18, the end portion of the flow path member 18 can be more easily fit into the recessed portion 38. Accordingly, the recording head 3 and also the printer 1 can be manufactured more easily. The other structures are similar to those in the first embodiment, and accordingly, their descriptions are omitted.

Figure 6:
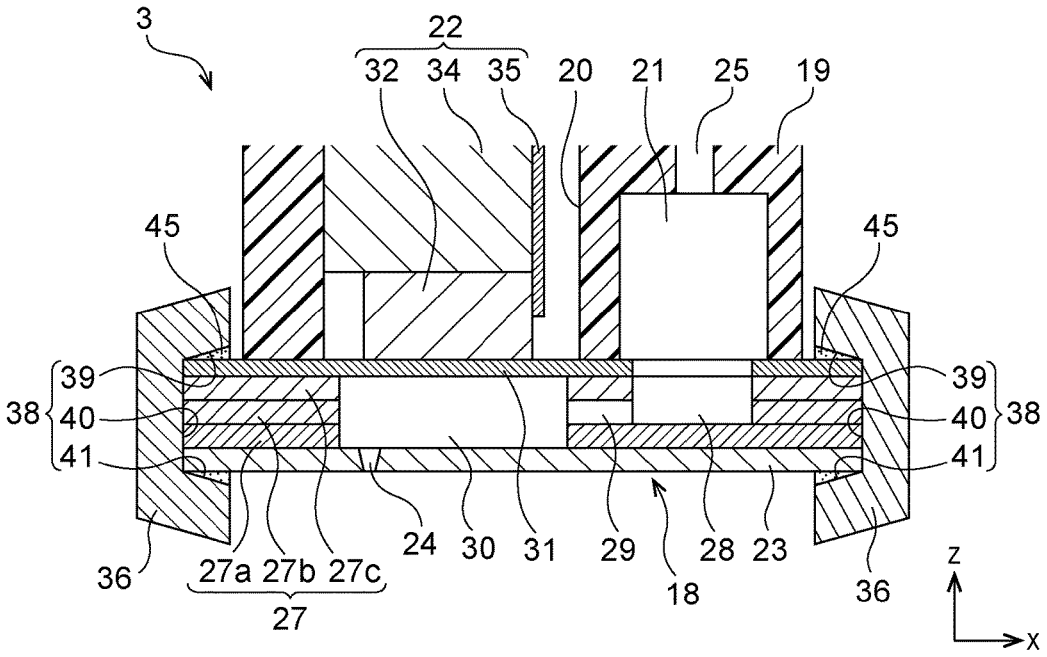
FIG. 6 is a cross-sectional view of a recording head according to a fourth embodiment.

A holding member 36 according to the fourth embodiment illustrated in FIG. 6 is similar to that in the second embodiment illustrated in FIG. 4 in that the recessed portion 38 has three surfaces inside the recessed portion 38: the first surface 39, the second surface 40, and the third surface 41. However, the holding member 36 according to the embodiment is different from that in the second embodiment in that the first surface 39 and the third surface 41 are slightly inclined. Specifically, the holding member 36 includes the first surface 39 that is slightly inclined downward toward the second surface 40 with respect to the upper surface of the flow path member 18, the second surface 40 that faces the end surface of the flow path member 18 and is parallel to the end surface, and the third surface 41 that is slightly inclined upward toward the second surface 40 with respect to the lower surface of the flow path member 18. The height (the dimension in the z direction) of the second surface 40 is substantially the same as the thickness of the flow path member 18. The holding member 36 having the recessed portion 38 is attached to the flow path member 18 by the filler 45 that is filled between the upper surface of the flow path member 18 and the first surface 39 and between the lower surface of the flow path member 18 and the third surface 41 in a state the second surface 40 and the end surface of the flow path member 18 are in contact with each other.

Since the second surface 40 of the holding member 36 is in contact with the end surface of the flow path member 18, even if the plates that constitute the flow path member 18 extend in the direction (x direction) intersecting the nozzle array direction with the temperature rise of the flow path member 18, the holding member 36 can further suppress the extension. That is, the plates that constitute the flow path member 18 are further prevented from extending (expanding) in the direction (x direction) intersecting the nozzle array direction. As a result, the adhesive that bonds the flow path plate 27 and the nozzle plate 23 and the adhesive that bonds the flow path plate 27 and the diaphragm 31 can be prevented from peeling off. Furthermore, since the opening of the recessed portion 38 is open toward the inside of the flow path member 18, the end portion of the flow path member 18 can be more easily fit into the recessed portion 38. Accordingly, the recording head 3 and also the printer 1 can be manufactured more easily. The other structures are similar to those in the second embodiment, and accordingly, their descriptions are omitted.

Figure 7:
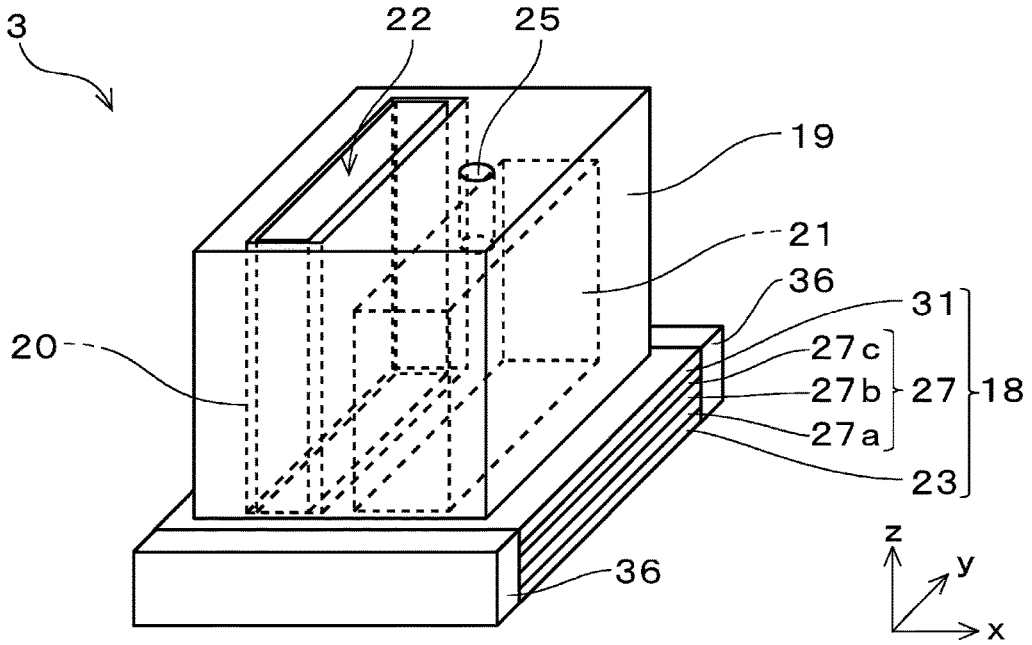
FIG. 7 is a perspective view of a recording head according to a fifth embodiment.

In the above-described embodiments, the holding members 36 are fixed to both end surfaces of the flow path member 18 in the direction (x direction) intersecting the nozzle array direction, however, the structures are not limited to these examples. For example, in the fifth embodiment illustrated in FIG. 7, the holding members 36 are fixed to both end surfaces of the flow path member 18 in the nozzle array direction (y direction). The holding member 36 according to the embodiment is a plate-like member that has stiffness higher than that of a plate (in this embodiment, the nickel nozzle plate 23 or the nickel diaphragm 31) that has the highest coefficient of linear expansion in the nozzle array direction (y direction) among the plates in the flow path member 18. The holding member 36 according to the embodiment is elongated in the widthwise direction (x direction) of the flow path member 18 and the dimension of the holding member 36 in the widthwise direction is the same as that of the flow path member 18. The thickness (the dimension in the z direction) of the holding member 36 is substantially the same as the thickness of the flow path member 18. The dimension of the holding member 36 in the widthwise direction (y direction) may be any dimension as long as deformation of the flow path member 18 can be suppressed, for example, a dimension larger than the thickness of the flow path member 18. Specifically, the holding member 36 may be a plate that has dimensions, for example, a dimension in the x direction within a range from about 7 mm to about 12 mm, a dimension in the y direction within a range from about 2 mm to about 4 mm, and a dimension in the z direction within a range from about 0.4 mm to about 0.6 mm. The other structures are similar to those in the first embodiment, and accordingly, their descriptions are omitted.

As described above, since the holding members 36 are fixed to both end surfaces of the flow path member 18 in the nozzle array direction (y direction), even if the temperature of the flow path member 18 rises, the holding member 36 prevents the plates (specifically, the nozzle plate 23, the flow path plate 27, and the diaphragm 31) constituting the flow path member 18 from extending (expanding) in the nozzle array direction (y direction). In other words, even if the plates that constitute the flow path member 18 extend with the temperature rise in the flow path member 18, the holding members 36 can suppress the extension. Especially, since the holding members 36 can suppress the extension (expansion) of the flow path member 18, which extends (expands) greater in the lengthwise direction (y direction) than in the widthwise direction (x direction), due to heat in the lengthwise direction, the stress between the flow path plate 27 and the nozzle plate 23 and/or the diaphragm 31 can be further reduced. As a result, the adhesive that bonds the flow path plate 27 and the nozzle plate 23 and the adhesive that bonds the flow path plate 27 and the diaphragm 31 can be further prevented from peeling off. The holding member 36 may be a holding member 36 that has the recessed portion 38 according to any one of the second to fourth embodiments. In other words, a structure in which both end surfaces of the flow path member 18 in the nozzle array direction (y direction) are fit into the recessed portions 38 of the holding members 36 may be used.

Figure 8:
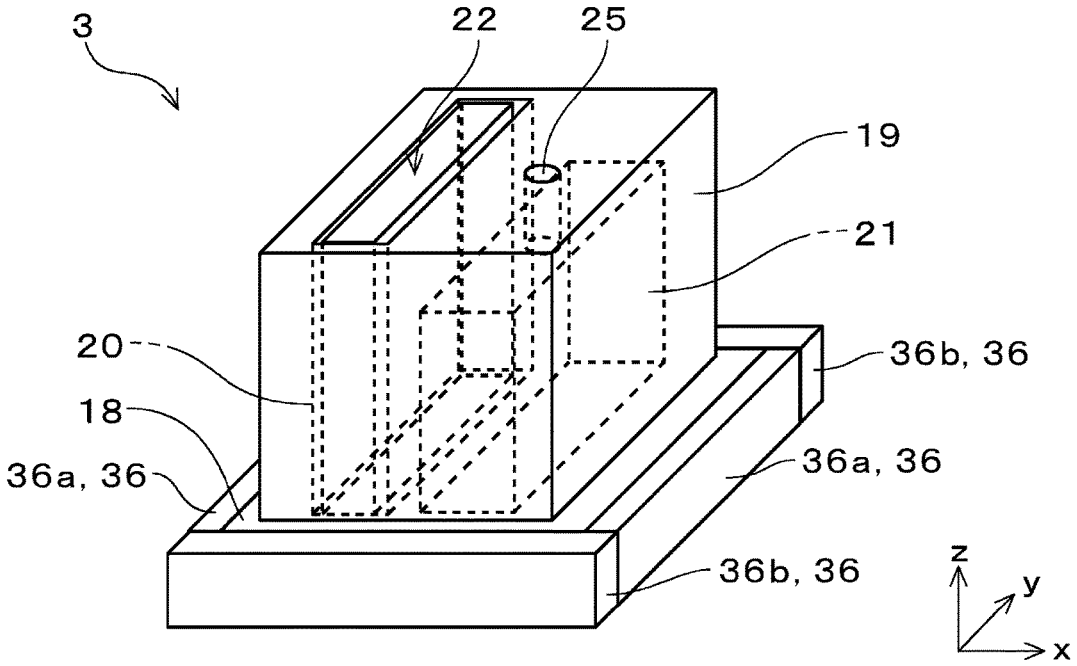
FIG. 8 is a perspective view of a recording head according to a sixth embodiment.

In the sixth embodiment illustrated in FIG. 8, the holding members 36 are fixed to both end surfaces of the flow path member 18 in the direction (x direction) intersecting the nozzle array direction and to both end surfaces of the flow path member 18 in the nozzle array direction (y direction). In other words, the holding members 36 are attached so as to surround the end surfaces of the flow path member 18. The holding members 36 (hereinafter, referred to as first holding members 36*a*) that are attached to both ends of the flow path member 18 in the direction (x direction) intersecting the nozzle array direction are the same as the holding members 36 according to the above-described first embodiment, and their descriptions are omitted. The dimension of the holding members 36 (hereinafter, referred to as second holding members 36*b*), which are attached to both ends of the flow path member 18 in the nozzle array direction (y direction), in the direction (x direction) intersecting the nozzle array direction is the same as the dimension from the outer end of one first holding member 36*a* to the outer end of the other first holding member 36*a* of the two first holding members 36*a*. The first holding members 36*a* and the second holding members 36*b* are fixed by an adhesive or the like at the portions where the first holding members 36*a* and the second holding members 36*b* overlap each other. The other dimensions of the second holding member 36*b* are the same as those of the holding member 36 according to the fifth embodiment, and their descriptions are omitted.

Since the holding members 36 are fixed so as to surround the end surfaces of the flow path member 18, even if the plates that constitute the flow path member 18 extend in the direction (x direction) intersecting the nozzle array direction and the nozzle array direction (y direction) with the temperature rise of the flow path member 18, the holding members 36 can suppress the extension. In other words, the plates that constitute the flow path member 18 can be prevented from extending (expanding) outward. As a result, the adhesive that bonds the flow path plate 27 and the nozzle plate 23 and the adhesive that bonds the flow path plate 27 and the diaphragm 31 can be further prevented from peeling off.

With respect to the fixation of the first holding members 36*a* and the second holding members 36*b* to the flow path member 18, an adhesive may be used to fix the first holding members 36*a* to the flow path member 18 and the second holding members 36*b* to the flow path member 18, similarly to the above-described first embodiment. Alternatively, one of the first holding members 36*a* and the second holding members 36*b* may be fixed to the flow path member 18 and the other holding members may be fixed to the one holding members. For example, in the widthwise direction (x direction) of the flow path member 18, which extends relatively small with heat, an adhesive may be used to directly fix the end surfaces and the first holding members 36*a* together. On the other hand, in the lengthwise direction (y direction) of the flow path member 18, which extends relatively large with heat, an adhesive may be used to fix the second holding members 36*b* and the first holding members 36*a* while the second holding members 36*b* are in contact with the end surfaces. With this structure, the adhesive that bonds the flow path plate 27 and the nozzle plate 23 and the adhesive that bonds the flow path plate 27 and the diaphragm 31 can be prevented from peeling off while the holding members 36 are firmly fixed to the flow path member 18.

The first holding member and the second holding member may be holding members that have recessed portions as described in the second to fourth embodiments. In other words, the first holding member and the second holding member may be any one of the holding members according to the second to fourth embodiments. In such a case, both ends of the flow path member in the direction (x direction) intersecting the nozzle array direction and both ends of the flow path member in the nozzle array direction (y direction) have a structure according to any one of the second to fourth embodiments. Specifically, both end surfaces of the flow path member in the direction (x direction) intersecting the nozzle array direction and both end surfaces of the flow path member in the nozzle array direction (y direction) are fit into the recessed portions of the holding members. Alternatively, the holding member that surrounds the end surfaces of the flow path member is not limited to the holding member that includes the first holding members and the second holding members, which are provided separately. For example, a frame-shaped holding member that includes integrally formed first holding members and second holding members may be used.

In the above-described embodiments, the flow path plate 27 includes the plurality of plates (the first flow path plate 27*a*, the second flow path plate 27*b*, and the third flow path plate 27*c*). However, the structure of the flow path plate 27 is not limited to this example. For example, a flow path plate made of a single board may be used. Furthermore, the first flow path plate, the second flow path plate, and the third flow path plate may be made of different materials. Even though the flow path plate includes a plurality of plates of different materials having different coefficients of linear expansion, the extension (expansion) of the plates due to heat can be suppressed by the holding members and thereby the adhesive that bonds the plates can be prevented from peeling off. The materials of the nozzle plate 23, the flow path plate 27, and the diaphragm 31, which constitute the flow path member, are not limited to the above-described examples. For example, the nozzle plate may be formed of a metal such as stainless steel or silicon instead of nickel. Furthermore, the flow path plate may be formed of a metal such as stainless steel instead of silicon. Furthermore, the diaphragm may be formed of silicon dioxide (SiO2), resin, or stacked materials of resin and metal instead of nickel. The coefficients of linear expansion of respective plates in the flow path member may be different from each other, or the coefficient of linear expansion of only a part of the plates may be different.

In the above-described embodiments, the positions of both end surfaces of the plates of the flow path member 18 are the same in the direction (x direction) intersecting the nozzle array direction and in the nozzle array direction (y direction) respectively. However, the positions are not limited to these examples. In other words, among the end surfaces of the flow path member 18, at least the positions of the end surfaces of the plates to which the holding members 36 are attached may be aligned. To align the positions of the end surfaces of the plates, the end surfaces of the flow path member may be ground.

In the above-described embodiments, the longitudinal-vibration piezoelectric element has been used as an example piezoelectric element for causing the ink in the pressure chamber 30 to produce pressure fluctuations. However, the piezoelectric element is not limited to this example. For example, a flexure-vibration piezoelectric element, a heating element, and various actuators such as an electrostatic actuator that vary the volume of the pressure chamber by static electricity may be used. Furthermore, as an example recording head, the serial head that ejects the ink while moving (reciprocating) in the directions (main scanning direction) that intersect the transport direction (subscanning direction) of the recording medium 2 has been used. However, the recording head is not limited to this example. The present invention may be applied to a line head that has a plurality of recording heads arranged in a width direction of a recording medium and a printer that has the line head.

In the above-described embodiments, the ink jet recording head 3 has been described as an example liquid ejecting head. However, the present invention can be applied to other liquid ejecting heads that has a structure that includes a plurality of stacked plates. For example, the liquid ejecting head of the invention may be color material ejecting heads to be used for manufacturing color filters for liquid crystal displays and the like, electrode material ejecting heads to be used for forming electrodes for organic electro luminescence (EL) displays and field emission displays (FEDs), and bioorganic substance ejecting heads to be used for manufacturing biochips (biochemical elements). The color material ejecting heads for manufacturing displays eject, as example liquids, solutions of coloring materials of red (R), green (G), and blue (B). The electrode material ejection heads for electrode forming apparatuses eject, as example liquids, a liquid electrode material, and the bioorganic compounds ejecting heads for chip manufacturing apparatuses eject, as an example liquid, a solution of bioorganic compounds.

The entire disclosure of Japanese Patent Application No. 2016-249016, filed Dec. 22, 2016 is expressly incorporated by reference herein.

What is claimed is:

1. A liquid ejecting head comprising:

a structure having a plurality of stacked plates in which end surfaces at both sides in one direction are aligned, at least two plates of the plurality of staked plates have different coefficients of linear expansion in the one direction; and holding members configured to fix to and directly contact the structure at the end surfaces thereof at both sides in the one direction, the holding members having stiffness higher than stiffness of a plate having the highest coefficient of linear expansion in the one direction among the plates, wherein each of the holding members has a recessed portion, the recessed portion includes a first surface facing an upper surface of the structure and a second surface facing a lower surface.

2. The liquid ejecting head according to claim 1, wherein the end surfaces of the structure are fit in the recessed portions.

3. A liquid ejecting apparatus comprising:

a liquid ejecting head according to claim 2.

4. The liquid ejecting head according to claim 1, wherein the recessed portion includes a third surface facing the end surface of the structure, the end surface of the structure is in contact with the third surface of the recessed portion.

5. A liquid ejecting apparatus comprising:

a liquid ejecting head according to claim 4.

6. The liquid ejecting head according to claim 4, wherein the first surface of the recessed portion is inclined with respect to the upper surface of the structure, and the second surface of the recessed portion is inclined with respect to the lower surface of the structure.

7. The liquid ejecting head according to claim 6, wherein a filler is provided in a space between the upper surface of the structure and the first surface, and a filler is provided in a space between the lower surface of the structure and the second surface.

8. The liquid ejecting head according to claim 1, wherein a filler is provided between the structure and the holding members.

9. A liquid ejecting apparatus comprising:

a liquid ejecting head according to claim 8.

10. The liquid ejecting head according to claim 1, wherein in the structure including the plates, a plate contains silicon as a main component and a plate contains a metal as a main component.

11. A liquid ejecting apparatus comprising:

a liquid ejecting head according to claim 10.

12. A liquid ejecting apparatus comprising:

a liquid ejecting head according to claim 1.

13. The liquid ejecting head according to claim 1, wherein the holding members are fixed to and directly contact the structure at the end surfaces thereof without the need for an adhesive to fix the holding members to the at least two plates.

14. The liquid ejecting head according to claim 1, wherein the at least two plates comprise at least three plates, wherein a first plate of the three plates is sandwiched between the other two plates of the three plates, the first plate having a lower coefficient of linear expansion in the one direction than the other two plates.

15. The liquid ejecting head according to claim 1, wherein the at least two plates comprise at least three plates, wherein a first plate of the three plates is sandwiched between the other two plates of the three plates, the first plate comprising a different material than the other two plates.

16. The liquid ejecting head according to claim 1, wherein the first surface of the recessed portion is inclined with respect to the upper surface of the structure, the second surface of the recessed portion is inclined with respect to the lower surface of the structure, and the structure is held between the first surface and the second surface.

17. The liquid ejecting head according to claim 16, wherein a filler is provided in a space surrounded by the end surface of the structure, the first surface and the second surface.

* * * * *